US010428757B2

(12) United States Patent
Moriyama et al.

(10) Patent No.: US 10,428,757 B2
(45) Date of Patent: Oct. 1, 2019

(54) FUEL INJECTION CONTROL DEVICE FOR INTERNAL COMBUSTION ENGINE

(71) Applicant: TOYOTA JIDOSHA KABUSHIKI KAISHA, Toyota-shi, Aichi-ken (JP)

(72) Inventors: Yohei Moriyama, Toyoake (JP); Shinji Satoh, Toyota (JP); Daisuke Kobayashi, Kasugai (JP); Kohji Fujiwara, Seto (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 2 days.

(21) Appl. No.: 15/866,859

(22) Filed: Jan. 10, 2018

(65) Prior Publication Data

US 2018/0209370 A1 Jul. 26, 2018

(30) Foreign Application Priority Data

Jan. 20, 2017 (JP) ..... 2017-008605

(51) Int. Cl.

| | |
|---|---|
| ***F02D 41/36*** | (2006.01) |
| ***F02D 41/20*** | (2006.01) |
| ***F02D 41/24*** | (2006.01) |
| ***F02D 41/30*** | (2006.01) |
| ***F02D 41/26*** | (2006.01) |

(Continued)

(52) U.S. Cl.

CPC ..... *F02D 41/365* (2013.01); *F02D 41/20* (2013.01); *F02D 41/2467* (2013.01); *F02D 41/266* (2013.01); *F02D 41/3094* (2013.01); *F02D 41/3836* (2013.01); *F02D 45/00* (2013.01); *F02M 65/005* (2013.01); *F02D 41/047* (2013.01); *F02D 41/06* (2013.01); *F02D 2041/2055* (2013.01);

(Continued)

(58) Field of Classification Search

CPC .... F02D 41/365; F02D 41/20; F02D 41/2467; F02D 41/3094; F02D 41/3836; F02D 41/047; F02D 41/06; F02D 45/00; F02D 2041/2055; F02D 2041/2058; F02D 2041/389; F02D 2200/0602; F02D 2200/063; F02M 65/005

USPC ..... 123/472

See application file for complete search history.

(56) References Cited

U.S. PATENT DOCUMENTS

| | | | |
|---|---|---|---|
| 2012/0022771 | A1 | 1/2012 | Kita |
| 2015/0377172 | A1 | 12/2015 | Higuchi et al. |

(Continued)

FOREIGN PATENT DOCUMENTS

| | | | |
|---|---|---|---|
| DE | 10 2015 220 263 | A1 | 4/2016 |
| JP | 2001-098991 | A | 4/2001 |

(Continued)

*Primary Examiner* — Mahmoud Gimie
(74) *Attorney, Agent, or Firm* — Oliff PLC

(57) ABSTRACT

A fuel injection control device for an internal combustion engine includes an electronic control unit configured to execute division processing for learning for dividing a requested injection amount into an injection amount of partial lift injection of an in-cylinder injection valve and a port injection amount of injection of a port injection valve, detect, on the basis of at least one of a terminal electric potential of a coil and a current flowing through the coil, an inflection point of a change in induced electromotive force of the coil in time attributable to a decline in a relative speed of a mover with respect to the coil, and correct the energization processing at a time when the partial lift injection is executed based on a timing of the detection of the inflection point.

5 Claims, 9 Drawing Sheets

(51) Int. Cl.

| | |
|---|---|
| ***F02D 41/38*** | (2006.01) |
| ***F02D 45/00*** | (2006.01) |
| ***F02M 65/00*** | (2006.01) |
| *F02D 41/04* | (2006.01) |
| *F02D 41/06* | (2006.01) |

(52) U.S. Cl.
CPC ..... *F02D 2041/2058* (2013.01); *F02D 2041/389* (2013.01); *F02D 2200/0602* (2013.01); *F02D 2200/063* (2013.01)

(56) References Cited

U.S. PATENT DOCUMENTS

| | | | |
|---|---|---|---|
| 2016/0348604 | A1 | 12/2016 | Higuchi et al. |
| 2016/0363106 | A1 | 12/2016 | Mori et al. |
| 2017/0002765 | A1 | 1/2017 | Nakano et al. |

FOREIGN PATENT DOCUMENTS

| | | | |
|---|---|---|---|
| JP | 2006-063824 | A | 3/2006 |
| JP | 2010-255432 | A | 11/2010 |
| JP | 2012-026340 | A | 2/2012 |
| JP | 2012-202209 | A | 10/2012 |
| JP | 2015-190318 | A | 11/2015 |
| JP | 2016-008569 | A | 1/2016 |
| JP | 2016-079937 | A | 5/2016 |
| JP | 2016-223443 | A | 12/2016 |

| | | | | |
|---|---|---|---|---|
| #1 | INTAKE STROKE | COMPRESSION STROKE | EXPANSION STROKE | EXHAUST STROKE |
| | F/L | P/L P/L | | |
| #2 | EXHAUST STROKE | INTAKE STROKE | COMPRESSION STROKE | EXPANSION STROKE |
| | | F/L | P/L P/L | |
| #3 | EXPANSION STROKE | EXHAUST STROKE | INTAKE STROKE | COMPRESSION STROKE |
| | | | F/L | P/L P/L |
| #4 | COMPRESSION STROKE | EXPANSION STROKE | EXHAUST STROKE | INTAKE STROKE |
| | P/L P/L | | | F/L |

$Qd = Qpl * 1 + Qpl * 2 + Qf *$

FUEL INJECTION CONTROL DEVICE FOR INTERNAL COMBUSTION ENGINE

INCORPORATION BY REFERENCE

The disclosure of Japanese Patent Application No. 2017-008605 filed on Jan. 20, 2017 including the specification, drawings and abstract is incorporated herein by reference in its entirety.

BACKGROUND

1. Technical Field

The disclosure relates to a fuel injection control device for an internal combustion engine that controls an internal combustion engine in which each of a plurality of cylinders is provided with an in-cylinder injection valve opened by an electromagnetic force resulting from energization processing for a coil acting on a mover including a magnetic body and injecting a fuel into a combustion chamber and a port injection valve injecting the fuel into an intake passage.

2. Description of Related Art

A fuel injection control device is disclosed in, for example, Japanese Unexamined Patent Application Publication No. 2015-190318 (JP 2015-190318 A). The fuel injection control device learns the injection characteristics of an in-cylinder injection valve during partial lift injection during which the in-cylinder injection valve is opened such that the lift amount of a nozzle needle does not reach its maximum lift amount. The fuel injection control device learns the injection characteristics by detecting a timing at which the in-cylinder injection valve is closed based on a detected value of the electric potential of a minus-side terminal, which is the terminal opposite to the terminal of a coil that becomes the plus side when the in-cylinder injection valve is energized, and corrects an operation signal of the in-cylinder injection valve based on the injection characteristics.

SUMMARY

In the case of the configuration described above, electrical noise attributable to fuel injection of another cylinder may be superimposed on the detected value of the electric potential of the minus-side terminal in a case where the fuel injection of the cylinder is done during the detection of the electric potential of the minus-side terminal for the learning of the injection characteristics. Then, a decline in the accuracy of the learning of the injection characteristics may occur.

The disclosure provides a fuel injection control device for an internal combustion engine suppressing a decline in the accuracy of learning of the injection characteristics of partial lift injection that is attributable to fuel injection the in-cylinder injection valve of another cylinder.

An aspect of the disclosure relates to a fuel injection control device for an internal combustion engine in which each of a plurality of cylinders is provided with an in-cylinder injection valve and a port injection valve, the in-cylinder injection valve being configured to be opened by an electromagnetic force acting on a mover including a magnetic body, the electromagnetic force resulting from energization processing for a coil, the in-cylinder injection valve being configured to inject a fuel into a combustion chamber and the port injection valve being configured to inject the fuel into an intake passage. The fuel injection control device includes an electronic control unit. The electronic control unit is configured to execute division processing for learning, the execute division processing for learning dividing a requested injection amount for controlling control amounts of the internal combustion engine into a partial lift injection amount and a port injection amount, the partial lift injection amount being an injection amount of partial lift injection during which the in-cylinder injection valve is opened such that the in-cylinder injection valve does not reach a maximum lift amount by the energization processing, the port injection amount being an injection amount of the injection of the port injection valve. The electronic control unit is configured to execute inflection point detection processing, the inflection point detection processing detecting, on the basis of at least one of a terminal electric potential of the coil and a current flowing through the coil, an inflection point of a change in induced electromotive force of the coil in time attributable to a decline in a relative speed of the mover with respect to the coil resulting from closing of the in-cylinder injection valve by termination of the partial lift injection based on the division processing for learning. In addition, the electronic control unit is configured to execute correction processing, the correction processing correcting, on the basis of a timing of the detection of the inflection point, the energization processing at a time when the partial lift injection is executed.

According to the aspect of the disclosure, the requested injection amount is divided into the port injection amount and the partial lift injection amount. As a result, the period of the fuel injection from the in-cylinder injection valve of each cylinder is shortened, and thus the partial lift injection period of the cylinder that is an inflection point detection object and the period of the fuel injection by the in-cylinder injection valve of another cylinder can be sufficiently separated from each other. Accordingly, the inflection point detection processing that results from the termination of the partial lift injection being affected by electrical noise that is attributable to the fuel injection by the in-cylinder injection valve of another cylinder can be appropriately suppressed, and thus a decline in the accuracy of the learning of the injection characteristics of the partial lift injection due to the fuel injection by the in-cylinder injection valve of another cylinder can be effectively suppressed.

In the fuel injection control device according to the aspect of the disclosure, the electronic control unit may be configured to execute time division processing and multi-injection processing during at least one processing of cold start processing for the internal combustion engine and warm-up processing for a catalyst of the internal combustion engine. The time division processing may divide the requested injection amount into a full lift injection amount and the partial lift injection amount, the full lift injection amount being an injection amount of full lift injection during which the in-cylinder injection valve is opened while the in-cylinder injection valve reaches the maximum lift amount by the energization processing. The multi-injection processing may execute the partial lift injection based on the time division processing after the full lift injection based on the time division processing is executed.

In a case where the fuel injection is executed by the port injection valve in a state where the warm-up of the internal combustion engine is insufficient, examples of which include a time during the cold start processing and a time during the warm-up processing for the catalyst, a decline in the controllability of the air-fuel ratio in the combustion chamber is likely to occur due to adhesion of the injected fuel to a port. In the configuration described above, the fuel is injected from the in-cylinder injection valve during the cold start processing and the warm-up processing in this regard. At this time, in addition, the partial lift injection is executed after the full lift injection, and thus the fuel injected by the partial lift injection is allowed to drift around an ignition plug at an ignition timing. However, in this case, firstly, the inflection point detection processing may be affected by the magnetic flux excited by the full lift injection remaining during the partial lift injection. Secondly, the period of the fuel injection by the partial lift injection is likely to overlap the period of the fuel injection by the in-cylinder injection valve of another cylinder and the overlapping of the periods may result in a decline in the accuracy of the inflection point detection processing due to the noise that is attributable to the fuel injection by the in-cylinder injection valve of another cylinder. The accuracy of the inflection point detection, for example, may decline when the inflection point detection processing is executed during the partial lift injection executed during the cold start processing and the warm-up processing as described above. Accordingly, the utility value of the division processing for learning is particularly high.

In the fuel injection control device according to the aspect of the disclosure, the electronic control unit may be configured to execute the division processing for learning on condition that a request for executing the at least one processing during which the time division processing and the multi-injection processing are executed is not made.

According to the aspect of the disclosure, the division processing for learning is executed on condition that the request for the execution of the at least one processing as the original application of the partial lift injection is not made. Accordingly, the at least one processing is executed prior to the division processing for learning. As a result, hindrance to the at least one processing by the division processing for learning can be suppressed.

In the fuel infection control device according to the aspect of the disclosure, the electronic control unit may be configured to execute variable setting processing, the variable setting processing variably setting a target value of a pressure of the fuel supplied to the in-cylinder injection valve. The electronic control unit may be configured to execute fuel pressure control processing, the fuel pressure control processing controlling the pressure of the fuel supplied to the in-cylinder injection valve to be the target value resulting front the variable setting processing by operating a high-pressure fuel pump discharging the fuel in a fuel tank storing the fuel injected by the in-cylinder injection valve to an in-cylinder injection valve side, in addition, the electronic control unit may be configured to execute injection amount variable processing, the injection amount variable processing allowing the injection amount of the partial lift injection resulted from the division processing for learning to be larger in a case where the pressure of the fuel supplied to the in-cylinder injection valve is high than in a case where the pressure of the fuel supplied to the in-cylinder injection valve is low.

Even at the same duration of the energization processing, the injection amount is larger in a case where the pressure of the fuel is high than in a case where the pressure of the fuel is low. Accordingly, in the case of the same injection amount of the partial lift, injection responding to a learning request, the duration of the energization processing is shorter in a case where the pressure is high than in a case where the pressure is low. The inventors have found that the accuracy of the detection by the inflection point detection processing declines in a case where the duration of the energization processing is excessively short. In a case where the duration of the energization processing is excessively long, in contrast, the lift amount may unexpectedly reach its maximum value. In the configuration described above, the injection amount of the partial lift injection responding to the learning request is larger in a case where the pressure of the fuel is high than in a case where the pressure of the fuel is low. Accordingly, the energization processing that is appropriate for learning can be executed regardless of the level of the pressure.

In the fuel injection control device according to the aspect of the disclosure, the electronic control unit may be configured to execute injection sharing processing, the injection sharing processing dividing the requested injection amount, on the basis of an operation point of the internal combustion engine, into an injection amount of the injection by the in-cylinder injection valve and the port injection amount. In addition, the electronic control unit may be configured to execute the division processing for learning, by invalidating the division of the requested injection amount resulted from the injection sharing processing, at the operation point where the requested injection amount is entirely allocated to the port injection amount by the injection sharing processing.

According to the aspect of the disclosure, the division processing for learning is executed at the operation point where the entire requested injection amount is allocated to the port injection amount. The ratio of the injection amount of the partial lift injection to the requested injection amount tends to be relatively low. Accordingly, with the configuration described above, a change in the fuel injection that is determined by the injection sharing processing can be minimized by the division injection for learning.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein:

FIG. 8 is a graph illustrating a partial lift injection region according to the embodiment and so on;

DETAILED DESCRIPTION OF EMBODIMENTS

Figure 1:
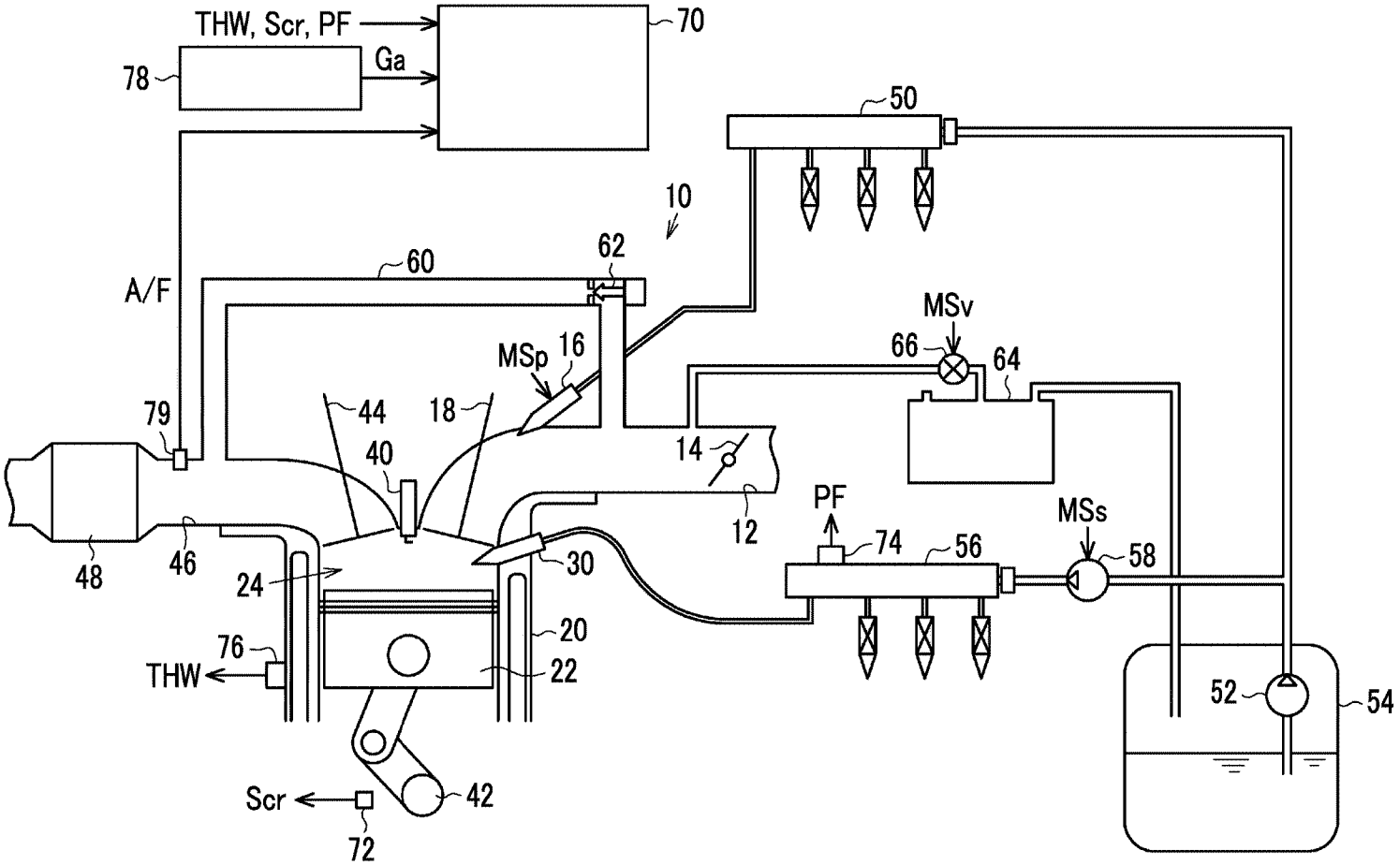
FIG. 1 is a diagram illustrating a fuel injection control device and an internal combustion engine according to an embodiment.

Hereinafter, an embodiment of a fuel injection control device for an internal combustion engine will be described with reference to accompanying drawings. As illustrated in FIG. 1, an internal combustion engine 10 is a spark ignition-type internal combustion engine that has four cylinders. A throttle valve 14 is disposed in an intake passage 12 of the internal combustion engine 10. The throttle valve 14 adjusts the cross-sectional area of the flow path of the intake passage 12. A port injection valve 16 is disposed downstream of the throttle valve 14. The port injection valve 16 injects a fuel into the intake passage 12. Air suctioned into the intake passage 12 and the fuel injected from the port injection valve 16 flow into a combustion chamber 24 when an intake valve 18 is opened. The combustion chamber 24 is partitioned by a cylinder 20 and a piston 22. An in-cylinder injection valve 30 injecting the fuel into the combustion chamber 24 and an ignition device 40 protrude from the combustion chamber 24. An air-fuel mixture of the air and the fuel injected from at least one of the port injection valve 16 and the in-cylinder injection valve 30 is subjected to combustion in the combustion chamber 24 as a result of spark discharge by the ignition device 40, and the combustion energy that results from the combustion is converted into the rotational energy of a crankshaft 42 via the piston 22. The air-fuel mixture subjected to the combustion is discharged to an exhaust passage 46 as exhaust gas when an exhaust valve 44 is opened. A catalyst 48 is disposed on the exhaust passage 46.

The port injection valve 16 injects the fuel that is supplied from a low-pressure delivery pipe 50. The fuel that is suctioned from the inside of a fuel tank 54 and discharged by a feed pump 52 is supplied to the low-pressure delivery pipe 50. The in-cylinder injection valve 30 injects the fuel that is supplied from a high-pressure delivery pipe 56. The fuel that is discharged from the feed pump 52 is supplied to the high-pressure delivery pipe 56 after the fuel is pressurized by a high-pressure fuel pump 58.

The exhaust passage 46 and the intake passage 12 of the internal combustion engine 10 are connected to each other by an EGR (Exhaust Gas Recirculation) passage 60. The FOR passage 60 is opened and closed by an EGR valve 62. A canister 64 collecting fuel vapor from the inside of the fuel tank 54 is connected to the fuel tank 54. The canister 64 is connected via a purge valve 66 to the side of the intake passage 12 that is disposed downstream of the throttle valve 14.

The internal combustion engine 10 is a control object of an electronic control unit 70. The electronic control unit 70 operates various actuators, such as the throttle valve 14, the port injection valve 16, the in-cylinder injection valve 30, the ignition device 40, the high-pressure fuel pump 58, and the purge valve 66, in order to control the control amounts (torque, exhaust components, and so on) of the internal combustion engine. During the control of the control amounts, the electronic control unit 70 captures output signals from a crank angle sensor 72 detecting the rotation angle of the crankshaft 42, a pressure sensor 74 detecting a pressure PF in the high-pressure delivery pipe 56, a coolant temperature sensor 76 detecting the temperature of a coolant (coolant temperature THW), an air flow meter 78 detecting an intake air amount Ga, and an air-fuel ratio sensor 79 detecting an air-fuel ratio A/F.

Figure 2:
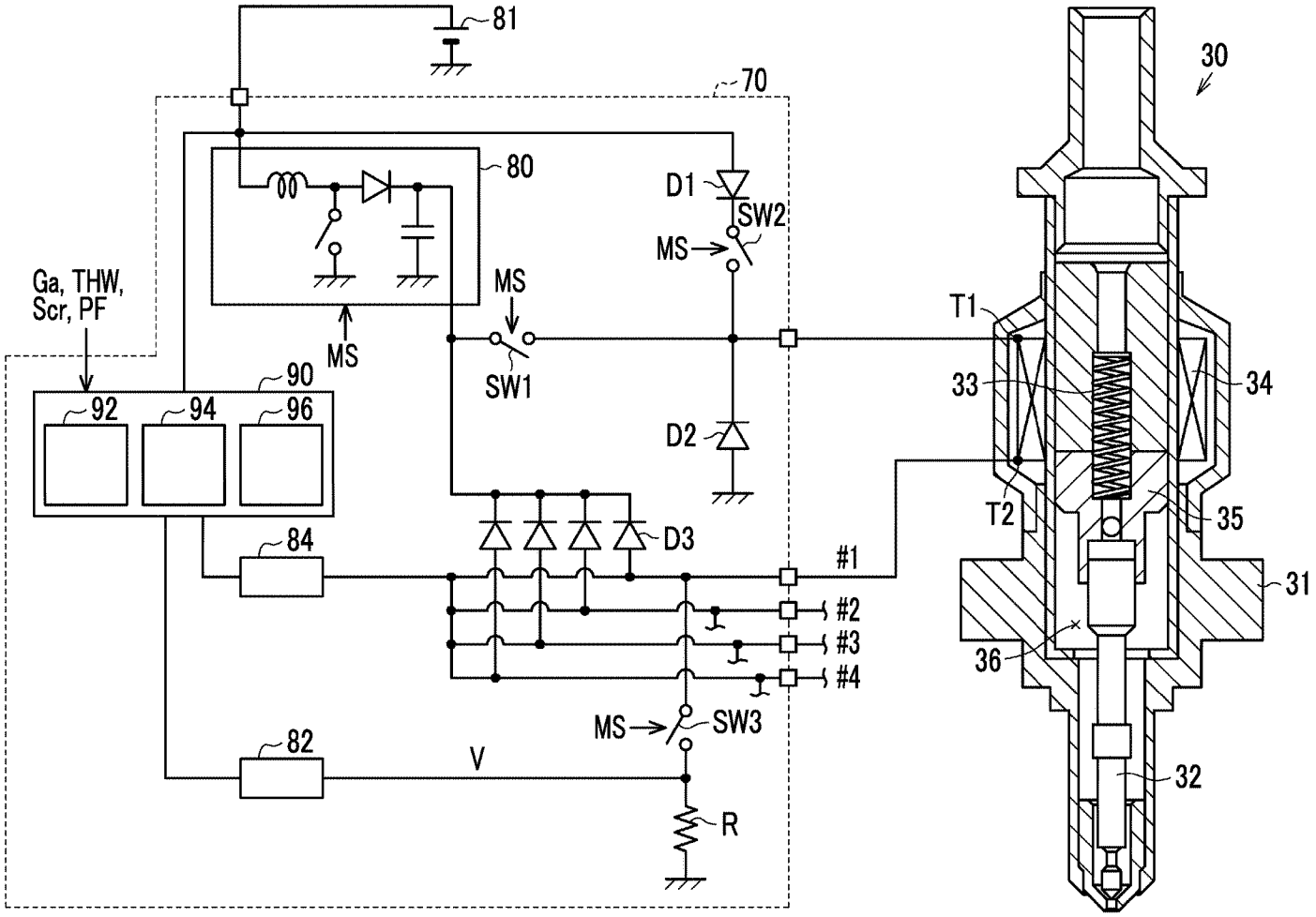
FIG. 2 is a diagram illustrating an electronic control unit and an in-cylinder injection valve according to the embodiment.

The configuration of the electronic control unit 70 and the configuration of the in-cylinder injection valve 30 are illustrated in part in FIG. 2. As illustrated in FIG. 2, a nozzle needle 32 is accommodated in a body 31 of the in-cylinder injection valve 30. The body 31 has a hollow structure. An elastic force in the valve-closing direction is exerted to the nozzle needle 32 by a spring 33 via a mover 35 that is displaced integrally with the nozzle needle 32 and includes a magnetic body. A void is disposed in the body 31. The void is closer to the tip side of the body 31 than the mover 35. The void is a fuel chamber 36 to which the fuel is supplied from the high-pressure delivery pipe 56. In addition, the in-cylinder injection valve 30 is provided with a coil 34. The in-cylinder injection valve 30 remains closed in a case where the electromagnetic force that results from the coil 34 does not act on the mover 35. The in-cylinder injection valve 30 is opened by the electromagnetic force that results from the coil 34 acting on the mover 35.

The electronic control unit 70 is provided with a booster circuit 80 boosting the voltage of a battery 81. The voltage boosted by the booster circuit 80 is applied to a first terminal T1 of the coil 34 via a switching element SW1. The voltage of the battery 81 can be applied to the first terminal T1 via a diode D1 and a switching element SW2. The cathode of a diode D2 is connected to the first terminal T1 and the anode of the diode D2 is grounded.

A second terminal T2 of the coil 34 is grounded via a switching element SW3 and a shunt resistor R. A voltage drop (electric potential V) of the shunt resistor R is converted into digital data by an A/D converter 82. In the present embodiment, the second terminals T2 of the respective coils 34 of the cylinders are connected to each other and the electric potentials of the second terminals 12 are converted into digital data by an AID converter 84. The second terminals T2 of the respective coils 34 of the cylinders are connected to the anodes of different diodes D3, and the cathodes of the diodes D3 are connected to the output terminal of the booster circuit 80.

The electronic control unit 70 is also provided with a microcomputer (microcomputer 90). The microcomputer 90 is provided with a CPU 92, a ROM 94, and an electrically rewritable nonvolatile memory 96. The control of the control amounts by the electronic control unit 70 is realized by the CPU 92 executing a program stored in the ROM 94.

Figure 3:
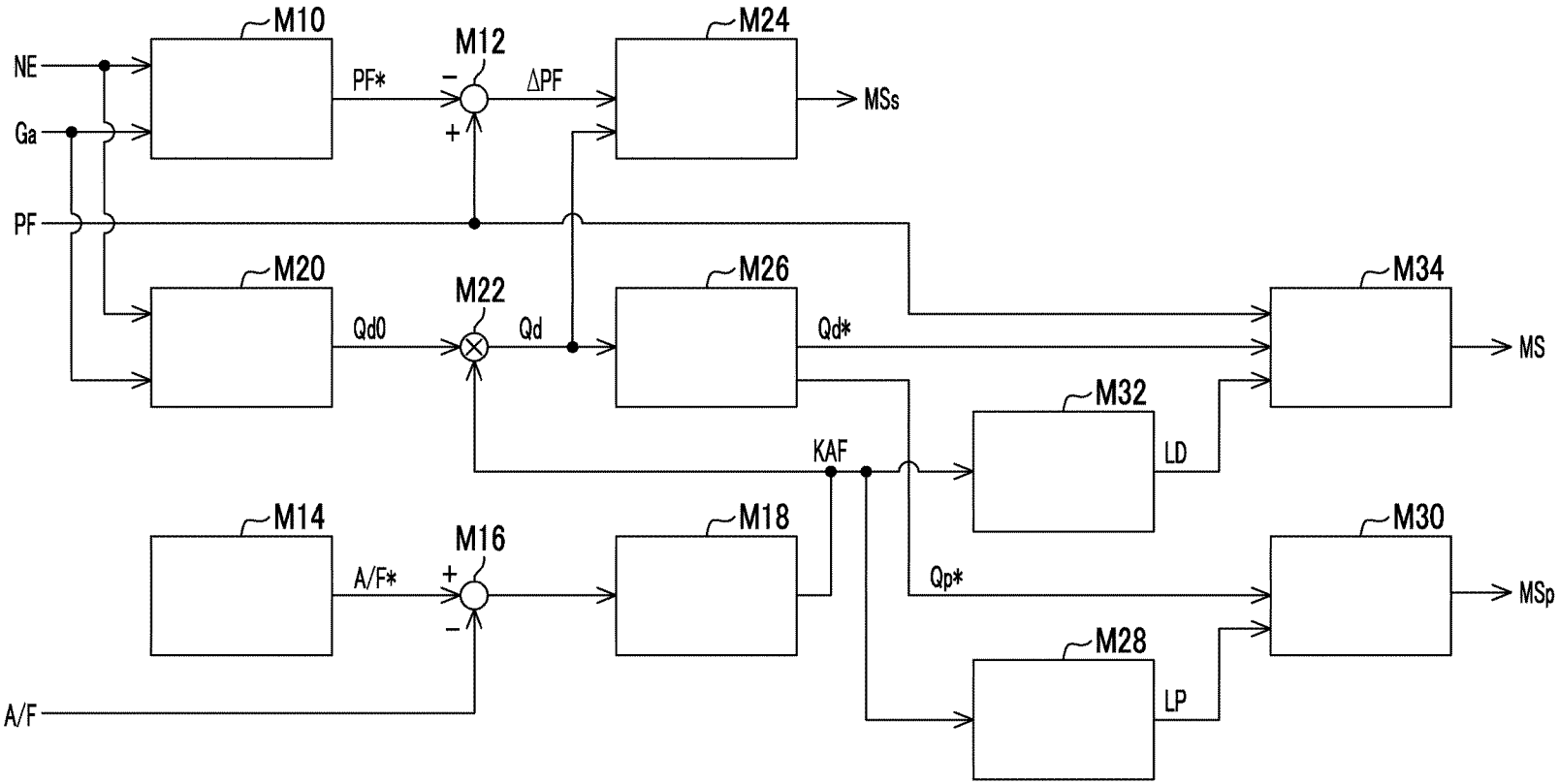
FIG. 3 is a block diagram illustrating a part of processing according to the embodiment.

The processing that is realized by the CPU 92 executing the program stored in the ROM 94 is illustrated in part in FIG. 3. A target fuel pressure setting processing unit M10 sets a target value PF* of the pressure in the high-pressure delivery pipe 56, based on the intake air amount Ga and a rotation speed NE calculated based on an output signal Scr of the crank angle sensor 72, such that the target value PF* is higher in a case where the amount of the air with which the combustion chamber 24 is filled is larger than in a case where the amount of the air is small. A deviation calculation processing unit M12 calculates the difference (deviation ΔPF) between the target value PF* and the pressure PF.

A target air-fuel ratio setting processing unit M14 sets a target air-fuel ratio A/F*. The target air-fuel ratio A/F* may be, for example, a stoichiometric air-fuel ratio. A deviation calculation processing unit M16 calculates the difference between the target air-fuel ratio A/F* and the air-fuel ratio A/F detected by the air-fuel ratio sensor 79. An air-fuel ratio feedback processing unit M18 calculates and outputs a feedback operation amount KAF based on the output value of the deviation calculation processing unit M16. The feedback operation amount KAF is an operation amount that is used for feedback control of the air-fuel ratio A/F to the target air-fuel ratio A/F*.

A requested injection amount calculation processing unit M20 calculates a original requested injection amount Qd0 based on the rotation speed NE and the intake air amount Ga. The original requested injection amount Qd0 is set to an amount that allows the air-fuel ratio of the air-fuel mixture subjected to the combustion in the combustion chamber 24 to reach the target air-fuel ratio A/F*.

A multiplication processing unit M22 calculates a requested injection amount Qd by multiplying the original requested injection amount Qd0 by the feedback operation amount KAF. A pump operation processing unit M24 generates and outputs an operation signal MSs of the high-pressure fuel pump 58 based on the requested injection amount Qd and the deviation ΔPF. The requested injection amount Qd is to calculate an open loop operation amount. The open loop operation amount is an operation amount that allows the fuel to be pumped from the high-pressure fuel pump 58 to the high-pressure delivery pipe 56 by the same amount as the requested injection amount Qd. The deviation ΔPF is to calculate a feedback operation amount as an operation amount for feedback control of the pressure PF to the target value PF*. In other words, the operation signal MSs is generated based on both the open loop operation amount and the feedback operation amount.

A division processing unit M26 divides the requested injection amount Qd into a port injection amount Qp* and an in-cylinder injection amount Qd*. The port injection amount Qp* is the injection amount of the injection by the port injection valve 16. The in-cylinder injection amount Qd* is the injection amount of the injection by the in-cylinder injection valve 30. Herein, the port injection amount Qp* is "Kpfi×Qd" and the in-cylinder injection amount Qd* is "Qd−Qp*" by an injection sharing ratio Kpfi that ranges from "0" to "1" being used.

Figures 4, 5:
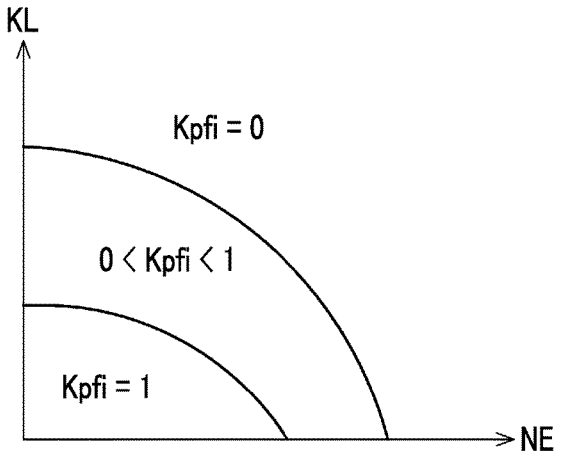
FIG. 4 is a graph illustrating an injection sharing ratio according to the embodiment.
FIG. 5 is a time chart illustrating fuel injection during quick warm-up processing and cold start processing according to the embodiment.

As illustrated in FIG. 4, the injection sharing ratio Kpfi is set to "1" in a low-rotation and low-load region, and is set to "0" in a high-rotation and high-load region, and is set to a value between "0" and "1" in the other region. According to FIG. 4, an operation point of the internal combustion engine 10 is determined from the rotation speed NE and a load KL and the injection sharing ratio Kpfi is defined in accordance with the operation point.

Referring back to FIG. 3, a port side learning processing unit M28 learns to output a learning value LP based on the feedback operation amount KAF at a time when the injection sharing ratio Kpfi is "1". The learning value LP is to correct the port injection amount Qp* such that the absolute value of the feedback operation amount KAF appropriately decreases.

A port side operation processing unit M30 calculates and outputs an operation signal MSp based on the port injection amount Qp* and the learning value LP. The operation signal MSp is to operate the port injection valve 16 such that the amount of the fuel that is injected from the port injection valve 16 reaches the port injection amount Qp*.

An in-cylinder side learning processing unit M32 learns to output a learning value LD based on the feedback operation amount KAF at a time when the injection sharing ratio Kpfi is "0". The learning value LD is to correct the in-cylinder injection amount Qd* such that the absolute value of the feedback operation amount KAF appropriately decreases.

An in-cylinder side operation processing unit 134 calculates and outputs an operation signal MS based on the in-cylinder injection amount Qd*, the pressure PF, and the learning value LD. The operation signal MS is to operate the in-cylinder injection valve 30 such that the amount of the fuel that is injected from the in-cylinder injection valve 30 reaches the in-cylinder injection amount Qd*. The operation signal MS is a signal for operating the switching elements SW1 to SW3 and so on.

In principle, the in-cylinder side operation processing unit M34 executes so-called full lift injection. A position at which the lift amount of the nozzle needle 32 reaches its maximum lift amount (position illustrated in FIG. 2) is reached during the full lift injection. However, in the present embodiment, both partial lift injection and the full lift injection are executed during cold start processing and quick warm-up processing of the catalyst 48. During the partial lift injection, the lift amount of the nozzle needle 32 does not reach the maximum lift amount. During the cold start processing and the quick warm-up processing, the CPU 92 sets the injection sharing ratio Kpfi to "0" without performing the processing for setting the injection sharing ratio Kpfi as illustrated in FIG. 4 in accordance with the operation point. The cold start processing is start processing at a time when the coolant temperature THW is a temperature equal to or lower than a specified temperature (such as 80° C.).

FIG. 5 shows fuel injection during the quick warm-up processing and the cold start processing. As illustrated in FIG. 5, during the quick warm-up processing and the cold start processing, the partial lift injection (shown as "P/L" in the drawing) is executed twice in a compression stroke after the full lift injection (shown as "F/L" in the drawing) is executed in an intake stroke. The execution of the full lift injection in the intake stroke is to increase the degree of mixing between the air and the fuel of the air-fuel mixture. The execution of the partial lift injection in the compression stroke is to allow the fuel resulting from the partial lift injection to drift with efficiency around the plug of the ignition device 40 at an ignition timing.

The sum of an injection amount Qf* of the full lift injection, a first injection amount Qpl*1 of the partial lift injection, and a second injection amount Qpl*2 of the partial lift injection is the requested injection amount Qd. In the present embodiment, the ignition timing is set past the compression top dead center during the quick warm-up processing, and thus the amount of heat of the exhaust gas resulting from the combustion is increased and the warm-up of the catalyst 48 is promoted.

In the present embodiment, the partial lift injection is executed even when the quick warm-up processing and the cold start processing are not performed so that the injection characteristics of the in-cylinder injection valve 30 relating to the partial lift injection are learned. When the learning of the injection characteristics is executed, learning (hereinafter, referred to as active learning) is performed by unusual fuel injection by the setting of the injection sharing ratio Kpfi that is illustrated in FIG. 4 being invalidated. Specifically, the partial lift injection by the in-cylinder injection valve 30 is executed and the fuel is injected by the port injection valve 16 by an injection amount unreachable by the partial lift injection among the requested injection amounts Qd. This will be described in detail below.

Figure 6:
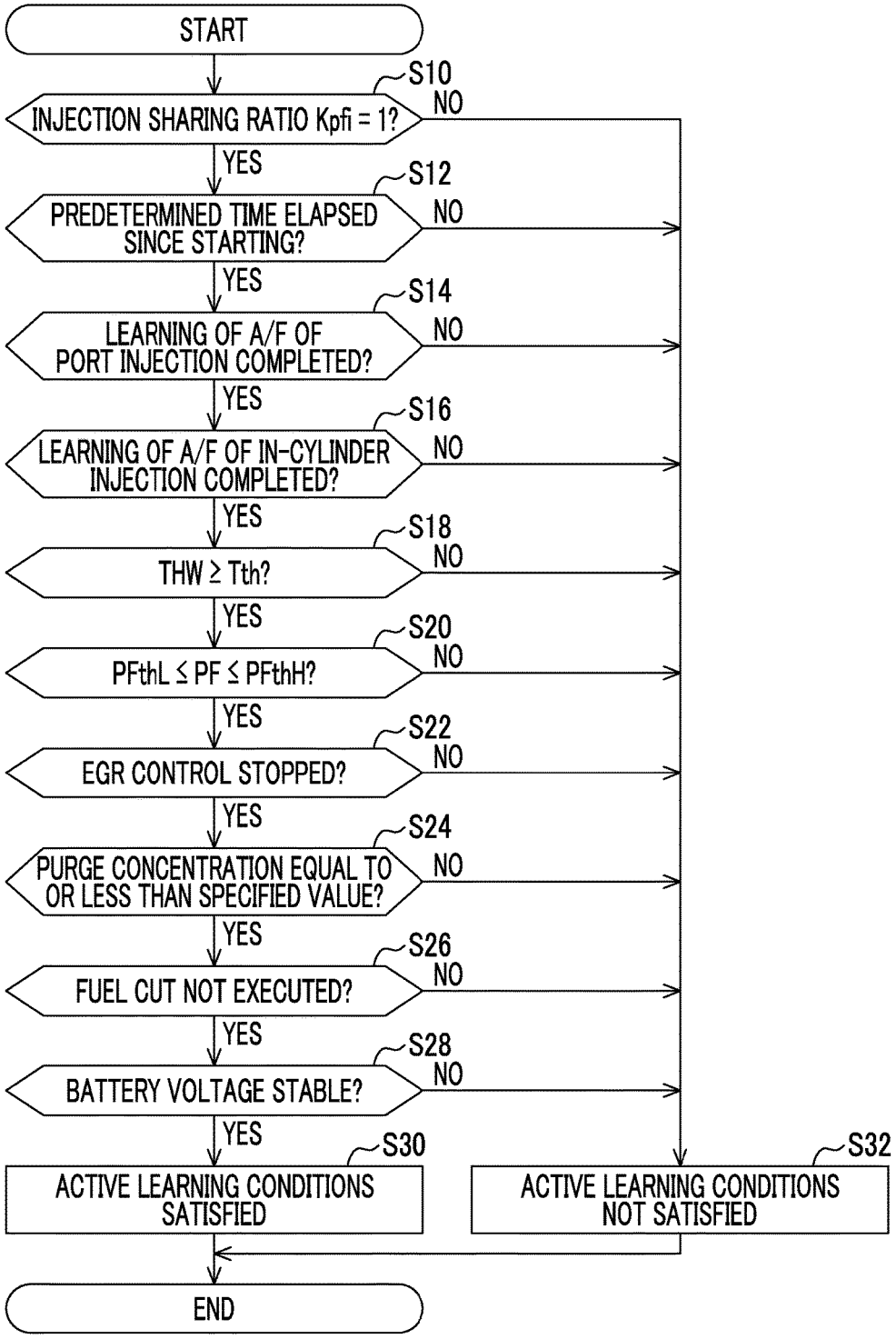
FIG. 6 is a flowchart illustrating a processing procedure for determining the satisfaction or non-satisfaction of an active learning condition according to the embodiment.

FIG. 6 shows a processing procedure for determining the satisfaction or non-satisfaction of a plurality of conditions of the active learning relating to the partial lift injection according to the present embodiment. The processing that is illustrated in FIG. 6 is realized by the CPU 92 repeatedly executing the program stored in the ROM 94 at, fur example, predetermined intervals. The numbers starting with "S" in the following description represent step numbers.

In the processing sequence that is illustrated in FIG. 6, the CPU 92 determines whether or not each of the conditions allowing the execution of the active learning is satisfied. In other words, the CPU 92 first determines whether or not the injection sharing ratio Kpfi determined in accordance with the operation point illustrated in FIG. 4 is "1" (S10). In a case where the CPU 92 determines that the injection sharing ratio Kpfi is "1" (S10: YES), the CPU 92 determines whether or not a predetermined time has elapsed since starting (S12). This processing is for the operation state of the internal combustion engine 10 being stable to be included in the active learning execution conditions. In a case where the CPU 92 determines that the predetermined time has elapsed (S12: YES), the CPU 92 determines whether or not the learning by the port side learning processing unit M28 (A/F learning in the drawing) is completed (S14). This processing aims to maintain a high level of air-fuel ratio controllability during the active learning in view of the use of the port injection valve 16 during the active learning. In a case where the CPU 92 determines that the learning by the port side learning processing unit M28 is completed (S14: YES), the CPU 92 determines whether or not the learning by the in-cylinder side learning processing unit M32 (A/F learning in the drawing) is completed (S16).

In a case where the CPU 92 determines that the learning by the in-cylinder side learning processing unit M32 is completed (S16: YES), the CPU 92 determines whether or not the coolant temperature THW is equal to or higher than a predetermined temperature Tth (S18). This processing is for the internal combustion engine 10 being warmed up to some extent to be included in the active learning execution conditions. In a case where the CPU 92 determines that the coolant temperature THW is equal to or higher than the predetermined temperature THW (S18: YES), the CPU 92 determines whether or not the pressure PF ranges from a lower limit value for learning PFthL to an upper limit value for learning PFthH (S20). This processing is for pressure PF being a pressure close to the pressure during the execution of the quick warm-up processing and the cold start processing to be included in the active learning execution conditions. The lower limit value for learning PFthL is the lowest value of the target value PF* during the quick warm-up processing and the cold start processing. The upper limit value for learning PFthH is the highest value of the target value PF* during the quick warm-up processing and the cold start processing.

In a case where the CPU 92 determines that the pressure PF ranges from the lower limit value for learning PFthL to the upper limit value for learning PFthH (S20), the CPU 92 determines whether or not EGR control is stopped with the EGR valve 62 fully closed (S22). This processing is to remove a time when the combustion may become unstable due to the EGR control from the active learning execution conditions. In a case where the CPU 92 determines that the EGR control is stopped (S22: YES), the CPU 92 determines whether or not a purge concentration is equal to or less than a specified value (S24). Specifically, the CPU 92 grasps the purge concentration based on the feedback operation amount KAF. In a case where the purge valve 66 remains closed, the CPU 92 estimates the purge concentration at zero. The processing of S24 aims to minimize the deterioration of the combustion that is attributable to the execution of the active learning.

In a case where the CPU 92 determines that the purge concentration is equal to or less than the specified value (S24: YES), the CPU 92 determines whether or not fuel cut processing is not executed (S26). In a case where the CPU 92 determines that the fuel cut processing is not executed (S26: YES), the CPU 92 determines whether or not the terminal voltage of the battery 81 is stable (S28). In a case where the terminal voltage is unstable, intended partial lift injection processing may not be executable. The processing of S28 aims to execute no active learning in such a situation in view of the potential impossibility.

In a case where the CPU 92 determines that the voltage of the battery 81 is stable (S28: YES), the CPU 92 determines that the active learning conditions are satisfied (S30). In the case of a negative determination in the processing of S10 to S28, in contrast, the CPU 92 determines that the active learning conditions are not satisfied (S32). The CPU 92 temporarily terminates the processing sequence that is illustrated in FIG. 6 in a case where the processing of S30 and the processing of S32 are completed.

Figure 7:
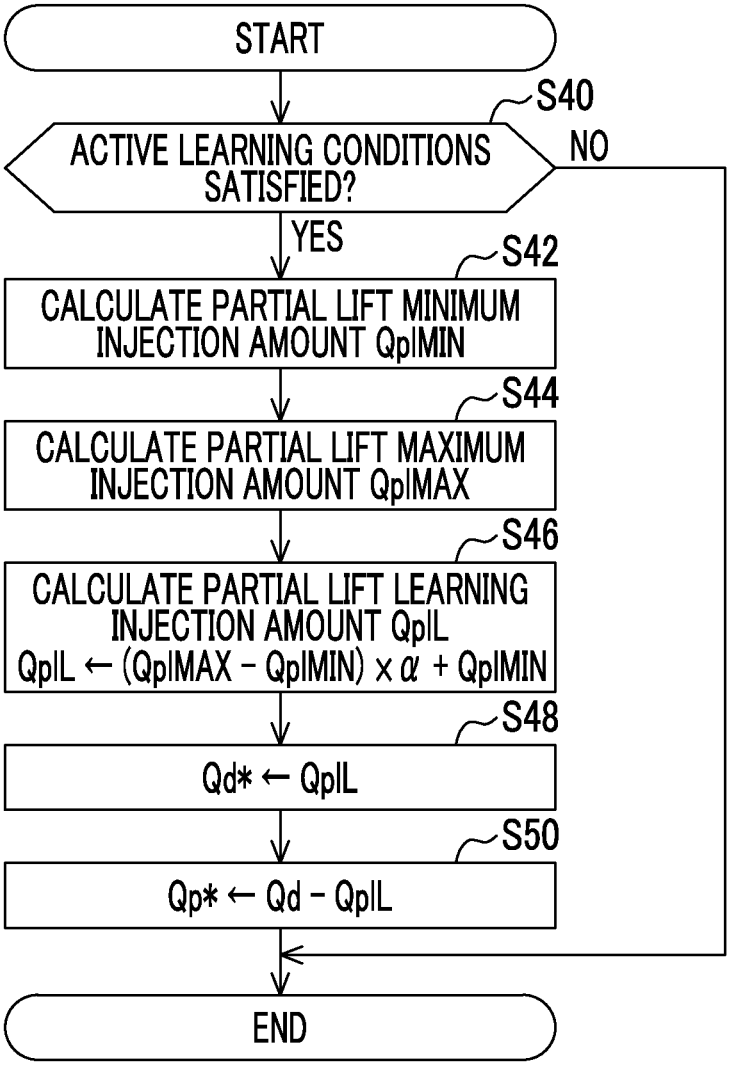
FIG. 7 is a flowchart illustrating a processing procedure for setting an injection amount during active learning according to the embodiment.

FIG. 7 shows a processing procedure for setting an injection amount for the active learning. The processing that is illustrated in FIG. 7 is realized by the CPU 92 repeatedly executing the program stored in the ROM 94 at, for example, predetermined intervals.

In the processing sequence that is illustrated in FIG. 7, the CPU 92 first determines whether or not the active learning conditions are satisfied (S40). In a case where the CPU 92 determines that the active learning conditions are satisfied (S40: YES), the CPU 92 calculates a partial lift minimum injection amount QplMIN based on the pressure PF (S42). The partial lift minimum injection amount QplMIN is the minimum injection amount of the partial lift injection. The partial lift minimum injection amount QplMIN is defined as a lower limit injection amount that has an injection amount variation within an allowable range.

Figure 8:
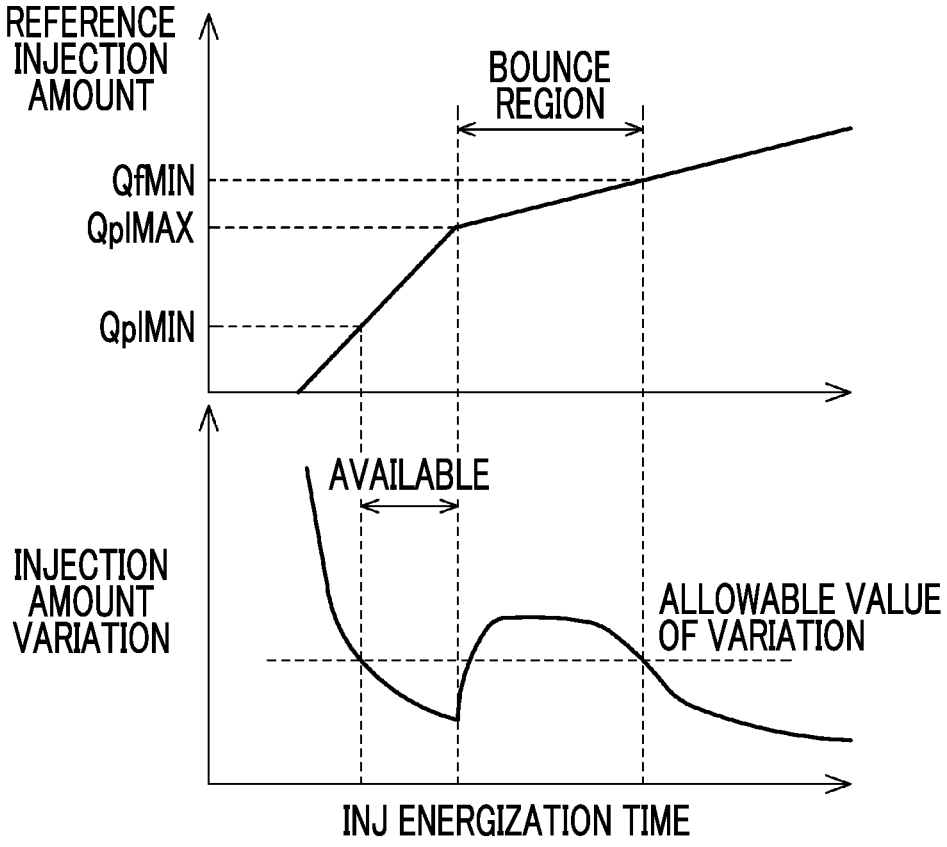

FIG. 8 shows a relationship among energization time with respect to the coil 34 of the in-cylinder injection valve 30 (shown as "INJ energization time" in the drawing), a reference injection amount with respect to the energization time, and a variation in actual injection amount with respect to the reference injection amount.

As illustrated in FIG. 8, the region that has a relatively short energization time with respect to the coil 34 has a large injection amount variation. Accordingly, the partial lift minimum injection amount QplMIN is set to a value at which the injection amount variation is an allowable value of variation determining the upper limit of the variation. The partial lift minimum injection amount QplMIN is larger in a case where the pressure PF is high than in a case where the pressure PF is low because the injection amount is larger in a case where the pressure PF is high than in a case where the pressure PF is low at the same energization time with respect to the coil 34.

Referring back to FIG. 7, the CPU 92 calculates a partial lift maximum injection amount QplMAX based on the pressure PF (S44). The partial lift maximum injection amount QplMAX is larger in a case where the pressure PF is high than in a case where the pressure PF is low because the injection amount is larger in a case where the pressure PF is high than in a case where the pressure PF is low at the same energization time with respect to the coil 34. In this regard, a bounce region is present between the partial lift maximum injection amount QplMAX and a full lift minimum injection amount QfMIN as illustrated in FIG. 8. The full lift minimum injection amount QfMIN is the minimum injection amount of the full lift injection. The bounce region is a region of the injection amount in which the energization processing for the coil 34 is terminated within a specified time from a timing at which the nozzle needle 32 reaches the maximum lift amount by being displaced in the valve-opening direction. Once the nozzle needle 32 reaches the maximum lift amount, the mover 35 comes into contact with the body 31 and bounces back. Accordingly, in a case where the energization processing is terminated at a timing that follows the timing at which the maximum lift amount is reached and is close to the timing, the injection amount may have a relatively large variation and the accuracy of injection amount control may deviate from an allowable range. Accordingly, in the present embodiment, the region of the injection amount in which the energization processing for the coil 34 is terminated within the specified time from the timing at which the nozzle needle 32 reaches the maximum lift amount by being displaced in the valve-opening direction is used as the bounce region and the fuel injection is executed with the bounce region avoided during the quick warm-up processing.

Referring back to FIG. 7, the CPU 92 calculates a partial lift learning injection amount QplL, which is an injection amount of the partial lift injection for learning, by the following equation (c1) (S46).

$$QplL=(Qpl\mathrm{MAX}-Qpl\mathrm{MIN})\times\alpha+Qpl\mathrm{MIN} \quad (c1)$$

The coefficient α in the equation (c1) is a value greater than "0" and less than "1", In the present embodiment, the coefficient α is set to a value of approximately "½", This is firstly because the accuracy of the learning tends to decline in a case where the partial lift learning injection amount QplL is excessively small. When the partial lift learning injection amount QplL is excessively large, in the meantime, the nozzle needle 32 may actually reach the maximum lift amount during the partial lift injection processing for learning due to, for example, the aging and the tolerance of the in-cylinder injection valve 30. Accordingly, in the present embodiment, an amount that is between the partial lift maximum injection amount QplMAX and the partial lift minimum injection amount QplMIN and differs from both the partial lift maximum injection amount QplMAX and the partial lift minimum injection amount QplMIN by at least a predetermined amount is used as the partial lift learning injection amount QplL.

The CPU 92 substitutes the in-cylinder injection amount Qd* with the partial lift learning injection amount QplL (S48) and substitutes the port injection amount Qp* with the value that is obtained by the partial lift learning injection amount QplL being subtracted from the requested injection amount Qd (S50).

Figure 9:
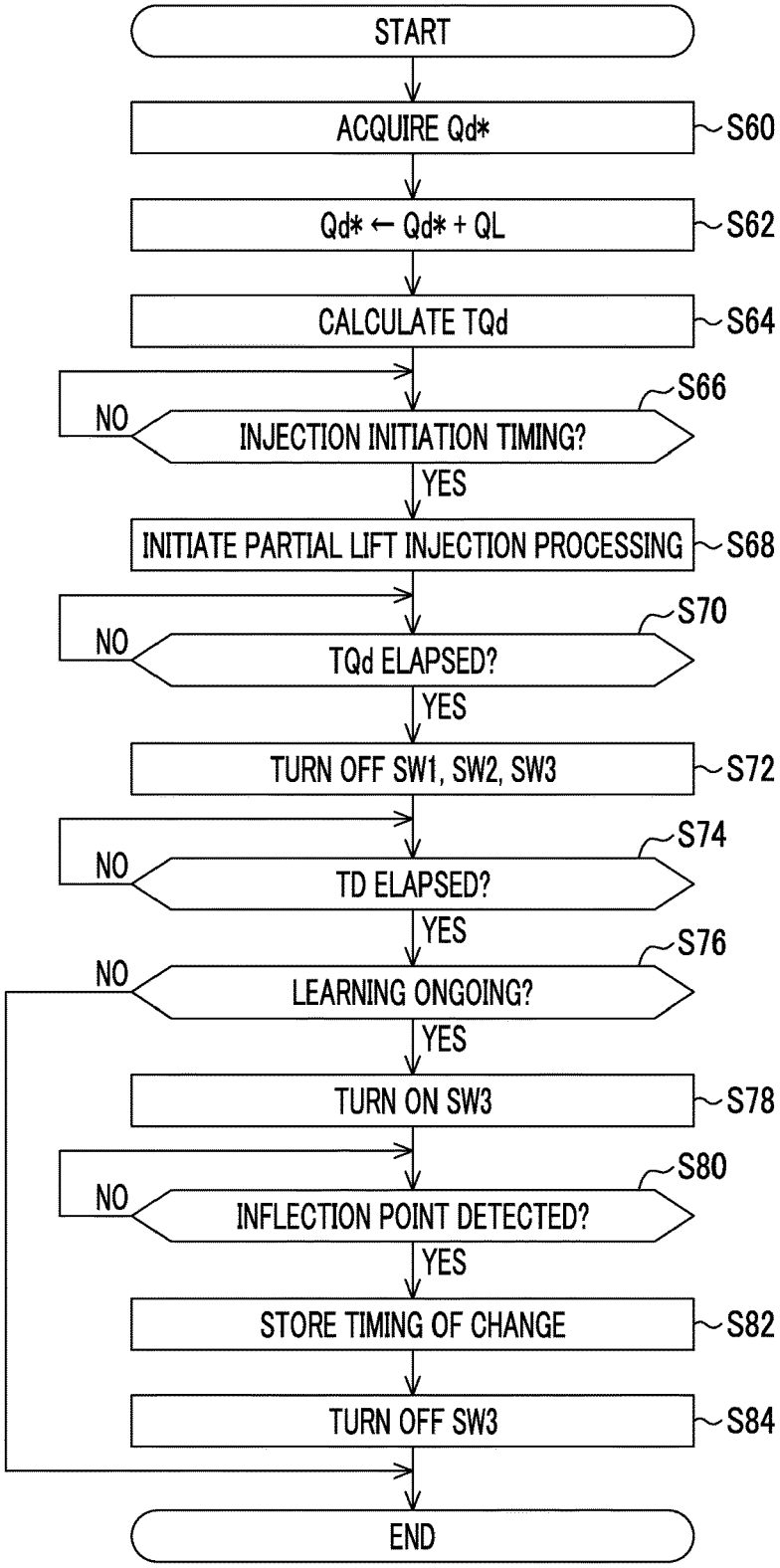
FIG. 9 is a flowchart illustrating a processing procedure for partial lift injection according to the embodiment.

In a case where the processing of S50 is completed and in the case of a negative determination in the processing of S40, the CPU 92 temporarily terminates the processing sequence that is illustrated in FIG. 7. FIG. 9 shows the procedure of partial lift injection processing and learning processing following the partial lift injection processing. The processing that is illustrated in FIG. 9 is realized by the CPU 92 executing the program stored in the ROM 94 every time a request for the execution of the partial lift injection is made. This processing is common to those during the quick warm-up processing and the cold start processing.

In the processing sequence that is illustrated in FIG. 9, the CPU 92 first acquires the in-cylinder injection amount Qd* (S60). Then, the CPU 92 corrects the in-cylinder injection amount Qd* by adding a correction amount QL to the in-cylinder injection amount Qd* (S62). The correction amount QL is calculated based on data relating to a learning result (described later) stored in the nonvolatile memory 96. Then, the CPU 92 calculates an energization time TQd for the coil 34 in the partial lift injection processing (S64). Then, the CPU 92 stands by until an injection initiation timing (S66: NO). In a case where the CPU 92 determines that the injection initiation timing is reached (S66: YES), the CPU 92 initiates the partial lift injection processing by initiating the energization processing for the coil 34 (S68).

Figure 10:
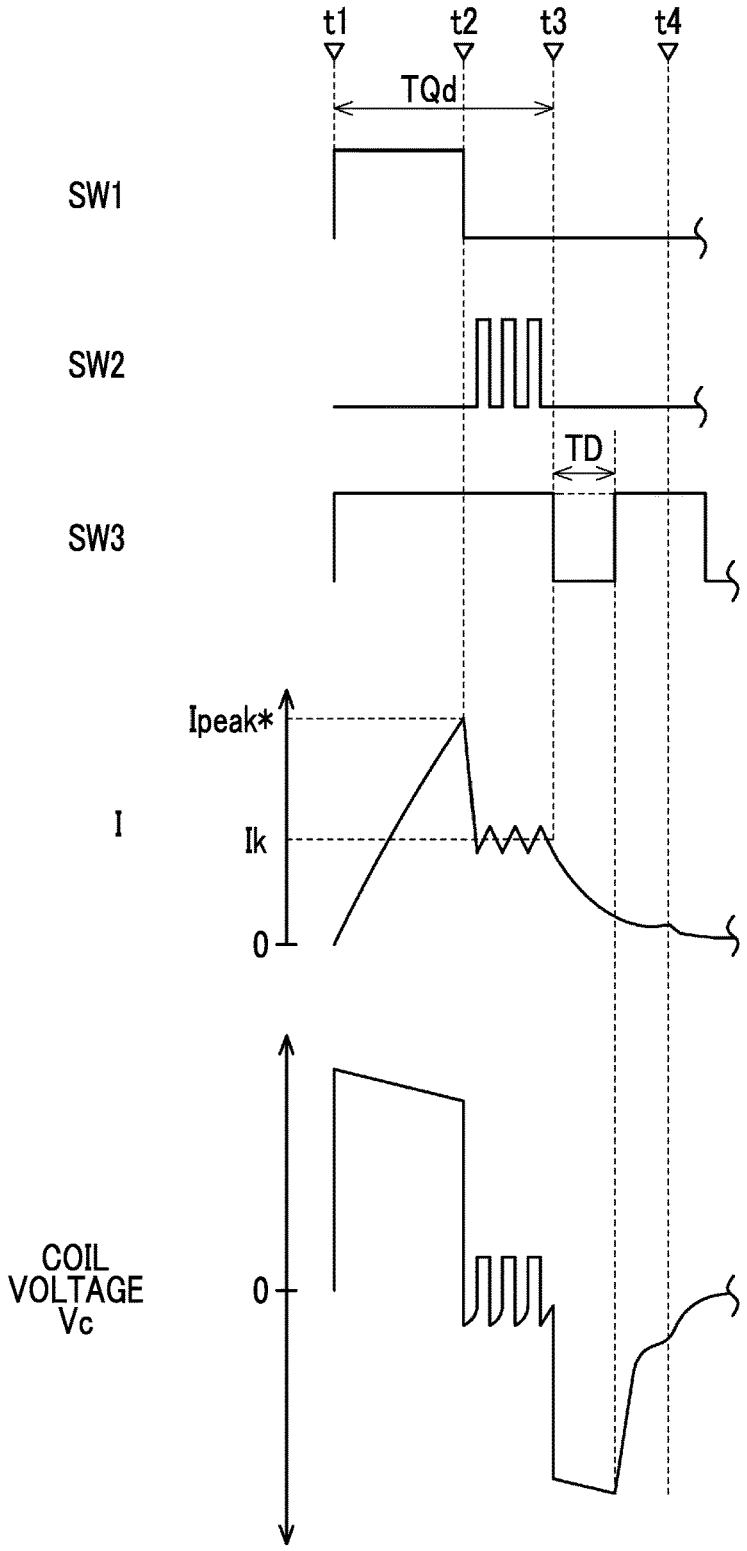
FIG. 10 is a time chart illustrating the partial lift injection according to the embodiment.

FIG. 10 shows the operation of the switching elements SW1 to SW3 by the partial lift injection processing along with a current I flowing through the coil 34 and a voltage Vc of the coil 34. According to FIG. 10, the voltage Vc of the coil 34 is positive in a case where the electric potential of the first terminal T1 is higher than the electric potential of the second terminal T2.

As illustrated in FIG. 10, the CPU 92 turns ON the switching elements SW1, SW3 at time t1, which is an initiation timing of the partial lift injection. As a result, the current I flows through the loop circuit of the booster circuit 80, the switching element SW1, the coil 34, the switching element SW3, and the shunt resistor R. The CPU 92 grasps the magnitude of the current I based on the electric potential V. Then, the CPU 92 switches the switching element SW1 to OFF at time t2, when the current I reaches a peak command value Ipeak*. As a result, the current I flows through the coil 34 via the loop path that is formed by the diode D2, the coil 34, the switching element SW3, and the shunt resistor R. The current I decreases at a rate that is proportional to the voltage drop of the shunt resistor R. Once the current I falls below a holding current Ik, the CPU 92 controls the current I to the holding current Ik by turning ON the switching element SW2.

Referring back to FIG. 9, the CPU 92 continues to control the holding current Ik until the energization time TQd elapses (S70: NO). The CPU 92 turns OFF the switching elements SW1 to SW3 (S72) once the energization time TQd elapses (S70: YES).

As a result, an induced electromotive force that allows the current I to continue to flow is generated in the coil 34, and thus the electric potential on the second terminal T2 side rises and the current that flows into the coil 34 from the diode D2 flows into the booster circuit 80 via the diode D3. At this time, the rate of decrease in the current I that flows through the coil 34 is controlled by the voltage of the booster circuit 80. Subsequently, the CPU 92 stands by until a damping promotion, time TD elapses (S74: NO).

Once the damping promotion time TD elapses (S74: YES), the CPU 92 determines whether or not the partial lift injection processing is done for learning, that is, whether or not learning is ongoing (S76). In a case where the CPU 92 determines that the learning is ongoing (S76: YES), the CPU 92 turns ON the switching element SW3 (S78). As a result, the rate of decrease in the current I that flows through the coil 34 is controlled by the magnitude (absolute value) of the voltage drop of the shunt resistor R. As illustrated in FIG. 10, the voltage Vc of the coil 34 is negative after time t3, when the switching element SW3 is turned OFF. This is because the induced electromotive force of the coil 34 is positive on the second terminal T2 side.

Referring back to FIG. 9, the CPU 92 monitors the generation of an inflection point of the rate of change in the voltage drop of the shunt resistor R (rate of change in the absolute value of the electric potential V) (S80). This is processing for detecting a valve-closing timing of the in-cylinder injection valve 30. In other words, the rate of displacement of the mover 35 rapidly falls once the in-cylinder injection valve 30 is closed although the mover 35 is displaced in the valve-closing direction before the in-cylinder injection valve 30 is closed. Accordingly, the relative speed of the mover 35 with respect to the coil 34 rapidly falls as a result of the closing of the in-cylinder injection valve 30, and a change in induced electromotive force occurs as a result. The change in induced electromotive force appears as an inflection point of change in the electric potential V. FIG. 10 shows that an inflection point is detected in the rate of change in the electric potential V (rate of change in the current I) by an inflection point being generated at time t4. The inflection point detection processing may be, for example, processing in which the timing at which the value that is obtained by a second filter value being subtracted from a first filter value reaches a threshold is set to be an inflection point detection timing with the first filter value obtained by the electric potential V being filtered by a first low pass filter and the second filter value obtained by the electric potential V being filtered by a second low pass filter. A cutoff frequency of the second low pass filter is lower than the first low pass filter.

Once the inflection point is detected (S80: YES), the CPU 92 stores the inflection point detection timing in the non-volatile memory 96 (S82) and turns OFF the switching element SW3 after a sufficient damping of the current I (S84). In a case where the processing of S84 is completed and in the case of a negative determination in S76, the CPU 92 temporarily terminates the processing sequence that is illustrated in FIG. 9.

The CPU 92 calculates the correction amount QL based on the inflection point detection timing in S80. In other words, the CPU 92 sets a reference valve-closing timing in accordance with the energization time TQd by the processing of S64, sets the correction amount QL to a negative value on condition that the detection timing is later than the reference valve-closing timing, and sets the correction amount QL to a positive value on condition that the detection timing is earlier than the reference valve-closing timing. In this manner, the CPU 92 corrects the in-cylinder injection amount Qd* during the partial lift injection in the processing of S62 such that the in-cylinder injection amount Qd* is smaller in the case of the detection timing is late than in the case of the detection timing is early. As a result, the energisation time TQd is corrected such that it is shortened.

The actions of the present embodiment will be described below. In a case where the active learning conditions are satisfied, the CPU 92 divides the requested injection amount Qd into the port injection amount Qp* and the in-cylinder injection amount Qd* for the partial lift injection. As a result, the period of the fuel injection by the in-cylinder injection valve 30 of each cylinder can be shortened, and thus the partial lift injection period of the cylinder that is an inflection point detection object and the period of the fuel injection by the in-cylinder injection valve 30 of another cylinder can be sufficiently separated from each other. Accordingly, the processing for detecting the inflection point that results from the termination of the partial lift injection being affected by electrical noise that is attributable to the fuel injection by the in-cylinder injection valve 30 of another cylinder can be appropriately suppressed, and thus a decline in the accuracy of the learning of the injection characteristics of the partial lift injection due to the fuel injection by the in-cylinder injection valve 30 of another cylinder can be effectively suppressed.

The following effects are also achieved with the present embodiment described above. During the cold start processing for the internal combustion engine 10 and the quick warm-up processing for the catalyst 48, the requested injection amount Qd is divided into a full lift injection amount and a partial lift injection amount and partial lift injection is executed after full lift injection. As a result, adhesion to a port of the fuel that is injected from the port injection valve 16 and a decline in the controllability of the air-fuel ratio in the combustion chamber 24 attributable to an insufficient warm-up of the internal combustion engine 10 can be avoided. In addition, the fuel injected by the partial lift injection is allowed to drift around the ignition plug at the ignition timing. However, during the quick warm-up processing and the cold start processing, the inflection point detection processing may be affected firstly by the magnetic flux excited by the full lift injection remaining during the partial lift injection. Secondly, the period of the fuel injection by the partial lift injection is likely to overlap the period of the fuel injection by the in-cylinder injection valve 30 of another cylinder and the overlapping of the periods may result in a decline in the accuracy of the inflection point detection processing due to the noise that is attributable to the fuel injection by the in-cylinder injection valve of another cylinder. The accuracy of the inflection point detection, for example, may decline when the inflection point detection processing is executed during the partial lift injection executed during the cold start processing and the quick warm-up processing as described above. Accordingly, the utility value of the active learning is particularly high.

The active learning is executed when neither a request for the execution of the cold start processing nor a request for the execution of the quick warm-up processing is made. As a result, hindrance to the cold start processing and the quick warm-up processing by the active learning can be avoided.

The injection amount of the partial lift injection by the active learning is larger in a case where the pressure PF is high than in a case where the pressure PF is low. As a result, the energization processing that is appropriate for learning can be executed regardless of the level of the pressure PF.

The active learning is executed when the injection sharing ratio Kpfi is "1". As a result, deviation of the fuel injection control based on the active learning from the fuel injection that is determined by the injection sharing processing for each operation point illustrated in FIG. 4 can be minimized.

During the active learning, the requested injection amount Qd is divided into the port injection amount and the unit partial lift injection amount. As a result, the port injection amount can be maximized.

Matters according to the embodiment described above and matters described in the "SUMMARY" have the following correspondence relationship. In the following description, the correspondence relationship will be shown for each number of the solving means described in the "SUMMARY".

The division processing for learning corresponds to the processing of S48, S50 )and the inflection point detection processing corresponds to the processing of S80. The inflection point detection processing using the terminal electric potential of the coil corresponds to the inflection point being detected based on the electric potential V. The electric potential V corresponds one-to-one to the current flowing through the coil 34 depending on the resistance value of the shunt resistor R, and thus it also corresponds to the inflection point being detected based on the current flowing through the coil 34. The correction processing corresponds to the processing of S62 and the fuel injection control device corresponds to the electronic control unit 70. The time division processing and the multi-injection processing correspond to the processing that is illustrated in FIG. 5. The condition that is defined by the processing of S10 corresponds to the active learning condition. The variable setting processing corresponds to the processing by the target fuel pressure setting processing unit M10, the fuel pressure control processing corresponds to the processing by the deviation calculation processing unit M12 and the pump operation processing unit M24, and the injection amount variable processing corresponds to the processing of S42, S44, S46. The injection sharing processing corresponds to the processing for setting the injection sharing ratio Kpfi that is defined in FIG. 4 and the condition for the execution of the division processing for learning corresponds to the condition that is defined by the processing of S10.

At least one of the details of the embodiment described above can be modified as follows. In the embodiment described above, the number of detection timings on which the calculation of the correction amount is based is not particularly mentioned. However, the correction amount may be calculated based on, for example, a single detection timing. Alternatively, the correction amount may be calculated based on, for example, an exponential moving average processing value based on time series data of detection timings.

In the embodiment described above, the in-cylinder injection amount Qd* during the partial lift injection is corrected based on the detection timing. However, the disclosure is not limited thereto and the energization time TQd may be corrected instead. In addition, for example, the peak command value Ipeak* may be corrected instead.

In the embodiment described above, the reference value of the detection timing is determined in accordance with the in-cylinder injection amount Qd* during the partial lift injection. However, the disclosure is not limited thereto. For example, it may be the average value of the detection timings of all of the cylinders. In this case, the energization time and the command value of the injection amount may be corrected such that the difference between the valve-closing timings of all of the cylinders is further reduced. In this case, the absolute value of the injection amount can be close to an appropriate value by the energization time and the command value of the injection amount of the partial lift injection being further corrected based on the operation amount of the air-fuel ratio feedback control although the absolute value of the amount of the fuel that is injected from the in-cylinder injection valve 30 is not necessarily corrected to the appropriate value. In this case, the learning processing by the full lift injection is completed prior to the learning processing.

A configuration in which wires for detecting the inflection points of time changes in induced electromotive force of the respective coils 34 of the cylinders are in a conduction state with each other is not limited to that exemplified in FIG. 2.

In the embodiment described above, the second terminals T2 of the respective coils 34 of the cylinders are connected to each other and the partial lift injection for the active learning is executed so that the effect of the noise that is attributable to the detection of the electric potentials of the connected second terminals T2 via the A/D converter 84 by the CPU 92 is avoided. However, the disclosure is not limited thereto. For example, a selector may be provided between the A/D converter 84 and the anode of the diode D3 corresponding to each cylinder. Even in this case, the execution of the partial lift injection for the active learning for avoiding the electrical noise attributable to the full lift injection at another cylinder having an effect on the input of the A/D converter 84 via the selector during the execution of the partial lift injection at one of the cylinders is effective.

In addition, the partial lift injection for the active learning may be executed so that, for example, superimposition of the noise from the wire connected to the in-cylinder injection valve 30 executing the full lift injection on the wire connected to the in-cylinder injection valve 30 executing the partial lift injection among the wires between the electronic control unit 70 and the second terminals T2 of the respective coils 34 of the cylinders is avoided.

A method for detecting the inflection point of the time change in induced electromotive force that is attributable to a decrease in the relative speed of the mover 35 with respect to the coil 34 is not limited to that exemplified in the embodiment described above. For example, a circuit may be used in which the anode of a diode for detection is connected to the second terminal T2 of the coil 34, the cathode of the diode for detection is connected to a first terminal of a capacitor, and a second terminal of the capacitor is grounded. In other words, in this case, the current of the coil 34 decreases while the current flows through the loop path that is formed by the diode D2, the coil 34, the diode for detection, and the capacitor by the energization processing being stopped. As a result, the inflection point of the time change in induced electromotive force of the coil 34 that is attributable to a decline in the relative speed of the mover 35 with respect to the coil 34 can be detected based on the electric potential V. The electric charge of the capacitor is removed until the next energization processing for the coil 34 after the closing of the in-cylinder injection valve 30.

The method for detecting the inflection point of the time change in induced electromotive force is not limited to that based on the detection of the electric potential on the second terminal T2 side of the coil 34. That based on the detection of the electric potential on the first terminal T1 side of the coil 34 can be realized by, for example, the following circuit being used. In other words, the circuit is a circuit in which the second terminal T2 is connected to the positive electrode of the battery 81 and the first terminal T1 is grounded via a resistor with the energization processing stopped. With this circuit, the inflection point of the time Change in induced electromotive force can be detected by the inflection point of the change in electric potential on the first terminal T1 side.

The detection of the inflection point of the time change in induced electromotive force is not limited to the use of a member electrically connected to the first terminal T1 side or the second terminal T2 side. For example, a current transformer that detects the current flowing through the coil 34 without being in contact with the coil 34 or the like may be used instead. In this case, the inflection point of the time change in induced electromotive force may be detected based on a change in the waveform of the current.

In the embodiment described above, the inflection point detection timing is the timing at which the value that is obtained by the second filter value being subtracted from the first filter value reaches the threshold. However, the disclosure is not limited thereto. For example, the timing at which the second derivative of the electric potential reaches its maximum may be detected as the inflection point detection timing.

The partial lift learning injection amount QplL is not limited to that calculated by the processing of S46. It may be a fixed value in a case where, for example, the range that can be taken by the target value PF* is narrow.

In the embodiment described above, the partial lift injection processing is executed twice after the full lift injection processing during the quick warm-up processing and the cold start processing. However, the disclosure is not limited thereto. For example, the partial lift injection processing may be executed once.

The use of the partial lift injection during both the quick warm-up processing and the cold start processing is optional and the partial lift injection may be used during either the quick warm-up processing or the cold start processing instead. The execution of the partial lift injection for the quick warm-up processing and the cold start processing is optional as well. For example, the partial lift injection may also be executed by lean combustion control being executed during a load-load operation or a medium-load operation after starting. Even in this case, the partial lift injection may be executed at a timing that follows the full lift injection and is close to the ignition timing so that the sprayed fuel drifts around the plug of the ignition device 40 at the ignition timing.

The partial lift injection during the active learning does not necessarily have to be executed once and may be executed twice or more. However, in this case, it is desirable that the inflection point is detected when the first injection is terminated and the energization processing for the second injection is executed on condition that the detection of the inflection point is completed.

The processing for setting the injection sharing ratio Kpfi in accordance with the operation point of the internal combustion engine 10 is not limited to that exemplified in FIG. 4. For example, the injection sharing ratio Kpfi may be "0" in the low-rotation and low-load region. In addition, for example, the injection sharing ratio Kpfi may be set such that it is either "1" or "0". The operation point does not necessarily have to be set in accordance with the rotation speed NE and the load KL. For example, the operation point may be set in accordance with the rotation speed NE without the load KL being referred to or in accordance with the load KL without the rotation speed NE being referred to.

The processing of S10 may be processing for determining whether or not the fuel is injected from the port injection valve 16 in the present mode instead of the processing for determining whether or not the injection sharing ratio Kpfi is "1".

The use of all of the conditions determined by the processing that is illustrated in FIG. 6 as the active learning conditions is optional. For example, the processing of S16 may be excluded. The execution of the active learning itself is optional as well. For example, the amount that is obtained by the partial lift learning injection amount QplL being subtracted from the requested injection amount Qd may be used as the port injection amount and the execution of the lean combustion control may be used as a learning execution condition during the execution of the lean combustion control as described in "Regarding Partial Lift Injection".

The fuel pressure control processing is not limited to the operation of the high-pressure fuel pump 58 for the feedback control of the pressure PF to the target value PF*. For example, the fuel pressure control processing may be the operation of the high-pressure fuel pump 58 simply by open loop control based on the requested injection amount Qd.

The fuel injection control device is not limited to that provided with the CPU 92 and the ROM 94 and executing the software processing. For example, it may be provided with a dedicated hardware circuit (such as an ASIC) performing hardware processing on at least a part of what is subjected to the software processing in the embodiment described above. In other words, the fuel injection control device may adopt any of the following configurations (a) to (c).

(a) The fuel injection control device is provided with a processing device executing the entire processing described above in accordance with a program and a program storage device such as a ROM storing the program.

(b) The fuel injection control device is provided with a program storage device and a processing device executing a part of the processing in accordance with a program and a dedicated hardware circuit executing the rest of the processing.

(c) The fuel injection control device is provided with a dedicated hardware circuit executing the entire processing described above.

A plurality of the software processing circuits provided with the processing device and the program storage device and a plurality of the dedicated hardware circuits may be provided. In other words, the processing may be executed by a processing circuit that is provided with at least one of one or more software processing circuits and one or more dedicated hardware circuits.

The internal combustion engine is not limited to the four-cylinder engine. The internal combustion engine may also be an internal combustion engine that has five or more cylinders, two cylinders, or three cylinders. Examples of the internal combustion engine that has five or more cylinders include a six-cylinder internal combustion engine and an eight-cylinder internal combustion engine.

What is claimed is:

1. A fuel injection control device for an internal combustion engine in which each of a plurality of cylinders is provided with an in-cylinder injection valve and a port injection valve, the in-cylinder injection valve being configured to be opened by an electromagnetic force acting on a mover including a magnetic body, the electromagnetic force resulting from energization processing for a coil, the in-cylinder injection valve being configured to inject a fuel into a combustion chamber and the port injection valve being configured to inject the fuel into an intake passage, the fuel injection control device comprising an electronic control unit configured to:

execute division processing for learning, the division processing for learning dividing a requested injection amount for controlling control amounts of the internal combustion engine into a partial lift injection amount and a port injection amount, the partial lift injection amount being an injection amount of partial lift injection during which the in-cylinder injection valve is opened such that the in-cylinder injection valve does not reach a maximum lift amount by the energization processing, the port injection amount being an injection amount of the injection of the port injection valve;

execute inflection point detection processing, the inflection point detection processing detecting, on the basis of at least one of a terminal electric potential of the coil and a current flowing through the coil, an inflection point of a change in induced electromotive force of the coil in time attributable to a decline in a relative speed of the mover with respect to the coil resulting from closing of the in-cylinder injection valve by termination of the partial lift injection based on the division processing for learning; and execute correction processing, the correction processing correcting, on the basis of a timing of the detection of the inflection point the energization processing at a time when the partial lift injection is executed.

2. The fuel injection control device according to claim 1, wherein the electronic control unit is configured to execute time division processing and multi-injection processing during at least one processing of cold start processing for the internal combustion engine and warm-up processing for a catalyst of the internal combustion engine, wherein:

the time division processing divides the requested injection amount into a full lift injection amount and the partial lift injection amount, the full lift injection amount being an injection amount of full lift injection during which the in-cylinder injection valve is opened while the in-cylinder injection valve reaches the maximum lift amount by the energization processing; and the multi-injection processing executes the partial lift injection based on the time division processing after the full lift injection based on the time division processing is executed.

3. The fuel injection control device according to claim 2, wherein the electronic control unit is configured to execute the division processing for learning on condition that a request for executing the at least one processing during which the time division processing and the multi-injection processing are executed is not made.

4. The fuel injection control device according to claim 1, wherein the electronic control unit is configured to:

execute variable setting processing, the variable setting processing variably setting a target value of a pressure of the fuel supplied to the in-cylinder injection valve;

execute fuel pressure control processing, the fuel pressure control processing controlling the pressure of the fuel supplied to the in-cylinder injection valve to be the target value resulting from the variable setting processing by operating a high-pressure fuel pump discharging the fuel in a fuel tank storing the fuel injected by the in-cylinder injection valve to an in-cylinder injection valve side; and execute injection amount variable processing, the injection amount variable processing allowing the injection amount of the partial lift injection resulted from the division processing for learning to be larger in a case where the pressure of the fuel supplied to the in-cylinder injection valve is high than in a case where the pressure of the fuel supplied to the in-cylinder injection valve is low.

5. The fuel injection control device according to claim 1, wherein the electronic control unit is configured to:

execute injection sharing processing, the injection sharing processing dividing the requested injection amount, on the basis of an operation point of the internal combustion engine, into an injection amount of the injection by the in-cylinder injection valve and the port injection amount; and execute the division processing for learning, by invalidating the division of the requested injection amount resulted from the injection sharing processing, at the operation point where the requested injection amount is entirely allocated to the port injection amount by the injection sharing processing.

* * * * *